US005901532A

United States Patent [19]

Bopp

[11] Patent Number: 5,901,532

[45] Date of Patent: May 11, 1999

[54] HORSE PACK FOR USE WITH WESTERN AND NON-WESTERN SADDLES

[76] Inventor: Lestia E. Bopp, P.O. Box 133, Donnelly, Id. 83615

[21] Appl. No.: 08/919,496

[22] Filed: Aug. 28, 1997

Related U.S. Application Data

[60] Provisional application No. 60/025,168, Aug. 28, 1996.

[51] Int. Cl.[6] ..... B68C 1/12; B68C 1/20

[52] U.S. Cl. ..... 54/66; 54/37.1; 224/905

[58] Field of Search ..... 54/37.1, 66; 224/191, 224/905

[56] References Cited

U.S. PATENT DOCUMENTS

| | | | |
|---|---|---|---|
| 193,288 | 7/1877 | Suter and Furney . | |
| 235,013 | 11/1880 | Pettus . | |
| 262,577 | 8/1882 | Day | 224/905 X |
| 2,672,264 | 3/1954 | Steven | 224/42.03 |
| 2,813,602 | 11/1957 | MacArthur, Jr. | 190/60 |
| 4,171,760 | 10/1979 | Gay | 224/241 |
| 4,185,444 | 1/1980 | Conken | 54/37.1 |
| 4,258,869 | 3/1981 | Hilgendorff | 224/32 A |
| 4,287,705 | 9/1981 | Frost et al. . | |
| 4,879,865 | 11/1989 | Van Scoyk | 54/66 |
| 5,184,762 | 2/1993 | Nevitt | 224/148 |
| 5,267,428 | 12/1993 | Mayo | 54/37.1 |
| 5,419,103 | 5/1995 | Edwards | 54/37.1 |

FOREIGN PATENT DOCUMENTS

| | | | |
|---|---|---|---|
| 1234 | 1/1889 | United Kingdom | 224/905 |

OTHER PUBLICATIONS

Photo of "Replica of Pony Express Saddle and Mochila" (source of this page unknown).

Excerpt from *American Heritage Dictionary*, American Heritage Publishing Co., Inc., 1969, definitions of "Mochila " and "Pannier".

*Primary Examiner*—Robert P. Swiatek

*Attorney, Agent, or Firm*—Ken J. Pedersen; Barbara S. Pedersen

[57] ABSTRACT

Embodiments of a pack system for bearing animals includes a large support panel for contacting a substantial area of the animal upon which it is placed. Preferably, the central longitudinal axis of the support panel is curved to contour to the animal's back. A plurality of bags or other carrying devices are connected to the support panel near four comers of the support panel, so that the weight of the load is widely-distributed on the animal, instead of on a small surface area of the animal behind the saddle as is the case in most conventional saddle bags. Fastening straps may be included to extend around the chest and the rear quarters of the animal to further stabilize the support panel with its bags, and the saddle which rests on the support system. Unlike conventional saddlebag systems, the invented system does not require attachment to or support from the saddle.

14 Claims, 6 Drawing Sheets

HORSE PACK FOR USE WITH WESTERN AND NON-WESTERN SADDLES

BACKGROUND OF THE INVENTION

This non-provisional utility patent application is a conversion of a co-pending provisional application entitled "Horse Pack for Use with Non-Western and Western Saddles", Ser. No. 60/025,168, filed Aug. 28, 1996, which is herein incorporated by reference.

FIELD OF THE INVENTION

This invention relates generally to devices for carrying items such as clothing, food, camping gear, etc., on a riding animal. More specifically, the invention relates to a pack device that reduces bruising and fatigue of the animal and stabilizes the saddle with which it is used. My invention relates to a pack device that does not require attachment to or support by a saddle.

RELATED ART

Conventional saddlebags have been designed for use specifically with American Western or other saddles having a skirt or other flattened projection extending from the base of the cantle and employ a means by which to attach the saddlebags to the skirt of the saddle. Heretofore many saddlebags have been devised that rely on the saddle for securement on the animal. Specifically, the narrow and elongated panel supporting the compartments on either side of the saddle requires that said panel and compartments be attached to the saddle to keep them in place on the animal. Typically, conventional saddlebags have small capacities. Some saddlebags have been devised to carry larger volumes of cargo, but continue to rely on a relatively narrow panel to support the larger compartments.

One such saddlebag design shown in U.S. Pat. No. 4,258,869 to Hilgendorff (1981) shows a saddle pack having a larger capacity and a plurality of compartments which requires attachment to the saddle to prevent rearward and lateral slippage. Forward slippage is prevented by the position of the support panel resting at the juncture of the cantle base and skirt of the western saddle. When used with a saddle of English, Australian or like design lacking a skirt, such a saddle pack has no means by which to prevent the support panel from slipping forward under the saddle. Additionally, this and all saddlebags designs that employ attachment to the saddle tend to cause slippage of the saddle which is known to cause injury to the animal's back. An additional disadvantage of this pack is that the support panel is relatively narrow compared to the compartments it supports causing excessive weight to be placed over a small area of the animal's back which is also known to cause injury to the animal. Hilgendorff teaches that one should not place his saddle pack behind the saddle while riding the animal if it is heavily loaded.

Another saddlebag design shown in U.S. Pat. No. 4,879,865 to Van Scoyk (Nov. 14, 1989) shows a saddle pad which includes small compartments attached to the pad along the rear and lower edges of both pad and compartments. The pad and compartments are prevented from slipping forward and laterally by the placement of the rear of the skirt of the saddle in an envelope formed between the saddle pad and the compartments. As with the above Hilgendorff patent, this saddlebag design tends to cause slippage of the saddle with possible injury to the animal's back. Additionally, such a pack is limited to carrying only a small amount of cargo.

Other patents disclose saddlebags that require attachment to a saddle and/or that feature a narrow support strip. For example, U.S. Pat. No. 193,288 to Suter et al. (Jul. 18, 1977) discloses a saddlebag designed specialized for carrying medical supplies and requires attachment to and support from a saddle. U.S. Pat. No. 235,013 to Pettus (Nov. 18, 1980) discloses a saddlebag design adapted for use as a briefcase. It also requires attachment to and support from a saddle.

Some designs from the past feature bags that lie across the top of Western saddles. One such design is commonly known as the pony express bag. The pony express bag is comprised of four relatively small bags attached to a panel which is designed to hook over the horn of a saddle and be stabilized by the weight of a rider sitting on the panel over the saddle.

Another over-the-saddle design is a pair of large bags connected by a panel which is placed over a Western riding saddle. The pack is stabilized by a pair of slots in the panel through which the horn and cantle of the saddle protrude, thereby preventing slippage off the saddle and by either straps or ropes going around the body of the animal. While such a pack may be used with a riding saddle, it is not possible to ride the animal at the same time.

SUMMARY OF THE INVENTION

Accordingly, several object and advantages of the invention are apparent. One object is to provide a means by which the weight of items carried on a riding animal may be dispersed over a broad area of the animal's back thereby reducing the stress and injury caused by excessive weight being placed over a relatively small area of the animal's back as with saddlebags of the prior art.

Another object is to provide a means by which items can be carried on the animal without the need to be attached directly or indirectly to a saddle. This advantageously enables the use of the invention with saddles such as English, Australian, or McClellan which may lack features which enable the attachment and support of saddlebags of the prior art, or use without a saddle.

Yet another object is to provide a means by which the load is prevented, independently of the saddle, from shifting forward or backward in steep terrain thereby eliminating the problem of the weight of the load pulling the saddle backward while climbing or pushing it forward during descent as with saddlebags of the previous art.

Other objects of the invention are to provide a means by which the load is prevented, independently of the saddle, from bouncing and swaying at faster gaits, and to provide a means for preventing the saddle from shifting forward or backward without additional accessories such as breast plate, crupper, etc.

Saddlebags have been used for many years to carry items on riding animals such as horses or mules. The saddlebags of the previous art have required attachment to, and/or support by a saddle. Most saddlebags and horn bags of the previous art require attachment to a saddle of typically Western design, having a horn, skirt, and saddle strings. These saddlebags are designed to rest on the skirt of the Western saddle behind the cantle and secured with the saddle strings or hooked over the horn. This presents a problem for the use of such saddlebags with English, Australian, McClellan or other saddle designs lacking a skirt, saddle strings, or horn. Another disadvantage of the saddlebags of the previous art is that they concentrate the entire weight of the load in two or more bags supported by a relatively narrow panel which rests on the saddle skirt directly over the animal's loins. This is commonly known to cause discomfort and injury to the animal if carrying a substantial amount of cargo because of the excessive weight they put on the delicate and critical loin and kidneys area of the animal's back. Yet another disadvantage of saddlebags of the previous art is that they are unstable. They tend to bounce against the animal and cause the saddle to slip especially in steep terrain resulting in yet more injury to the animal.

Recent saddle bag improvements have attempted to reduce the problem of bouncing and shifting of the bags by a variety of means. One large-capacity saddle bag uses extra strings attached to the bags which are then tied to the saddle or cinch, but this bag is not recommended for carrying heavy loads behind the saddle in its normal position for use while riding. Another design incorporates a sheath between pockets and a Western saddle pad into which the rear edge of a square Western saddle skirt is fitted, but is not capable of carrying a significant amount of cargo. Another saddle bag design shapes the support panel between the bags to closely fit the intersection of the cantle and skirt of a Western saddle. Another, older design has a panel which slips over the horn, seat and cantle of the saddle and is kept from bouncing by the seat and thighs of the rider. None of these designs adequately stabilizes-the loaded saddlebags to prevent bruising of the animal. None of these designs prevent the extra weight of the load from causing the saddle to shift, which shifting can cause saddle sores. None of these designs are able to carry a substantial amount of cargo weight on a riding animal without injury to the animal's back due to excessive pressure over too small an area of the back. Additionally, none of these designs provide a means for use with English and other non-Western saddles lacking a skirt, saddle strings, or horn.

My horse pack and method solves the problems of weight distribution, attachment, and slippage by a novel means. The horse pack according to my invention is able to carry a substantial amount of cargo without injuring the animal because it distributes the weight of the load over a much broader area of the animal's back than saddlebags of the previous art. It accomplishes this by dividing the load between four bags attached to the four corners of a modified rectangular support panel which rests on, and is supported by a substantial portion of, or all of, the back and a portion of the croup of the animal instead of just the loins or skirt of the saddle as with conventional saddlebags of the previous art. The support panel may be made to conform to the curvature of back of the animal which helps to eliminate pressure points and maintain proper position.

The bags of my invention are positioned as close to the saddle as possible, preferably in positions closely ahead of and closely behind the leg flaps or fenders of a saddle. The support panel and bags are preferably kept from rearward slippage by a strap attached to the support panel which goes around the animal's chest. Forward slippage is prevented preferably by a rear strap which may be positioned around the thighs or over the croup just above the tail. Even greater reduction of weight over the loins is attained if the rear strap is positioned in an alternative position over the croup and tightened to hold the weight of the rear bags. The saddle is placed over the support panel between the bags and secured to the horse by its girth or cinch.

My horse pack thus does not require attachment or connection to a saddle or support by a saddle, and can be used with any kind of saddle, or without a saddle. My horse pack support panel preferably does not include any apertures or slots, which are often included in prior art devices for placement around parts of the saddle. A further advantage of my horse pack is that, in addition to the bags being stabilized, the saddle may also be prevented from shifting forward or backward by the bags in the embodiment of FIG. 1A, or by the optional girth- or cinch-receiving straps 52R, 52L in the alternative embodiment of FIG. 1B. Thus, my horse pack offers novelty and advantage over the prior art by solving many of the problems inherent in the saddlebags of the previous art.

DESCRIPTION OF THE PREFERRED EMBODIMENTS

Referring to FIGS. 1–4, there are shown several, but not the only, embodiments of my invention. The details of my horse pack 10 are best understood by reference to the drawings wherein like parts are designated with like numerals throughout. In all descriptions and references to figures herein it should be noted that, for illustrative purposes, some parts of my horse pack may not be visible which are nonetheless described for a particular figure. All parts of my horse pack described in FIGS. 1–4, with the general exception of odd-numbered parts, can be assumed to be generally mirror image in character and relative location to their visible counterparts, with the mirror image parts designated by like numerals, but with different suffixes attached, that is, "R" for right side of the horse pack 10 and "L" for left side of the horse pack. Throughout the following description and especially in FIG. 5, parts of my invention are numbered without an "R" or "L" for simplicity, to refer to the part in general whether on right or left sides of the invention.

Figure 1A:
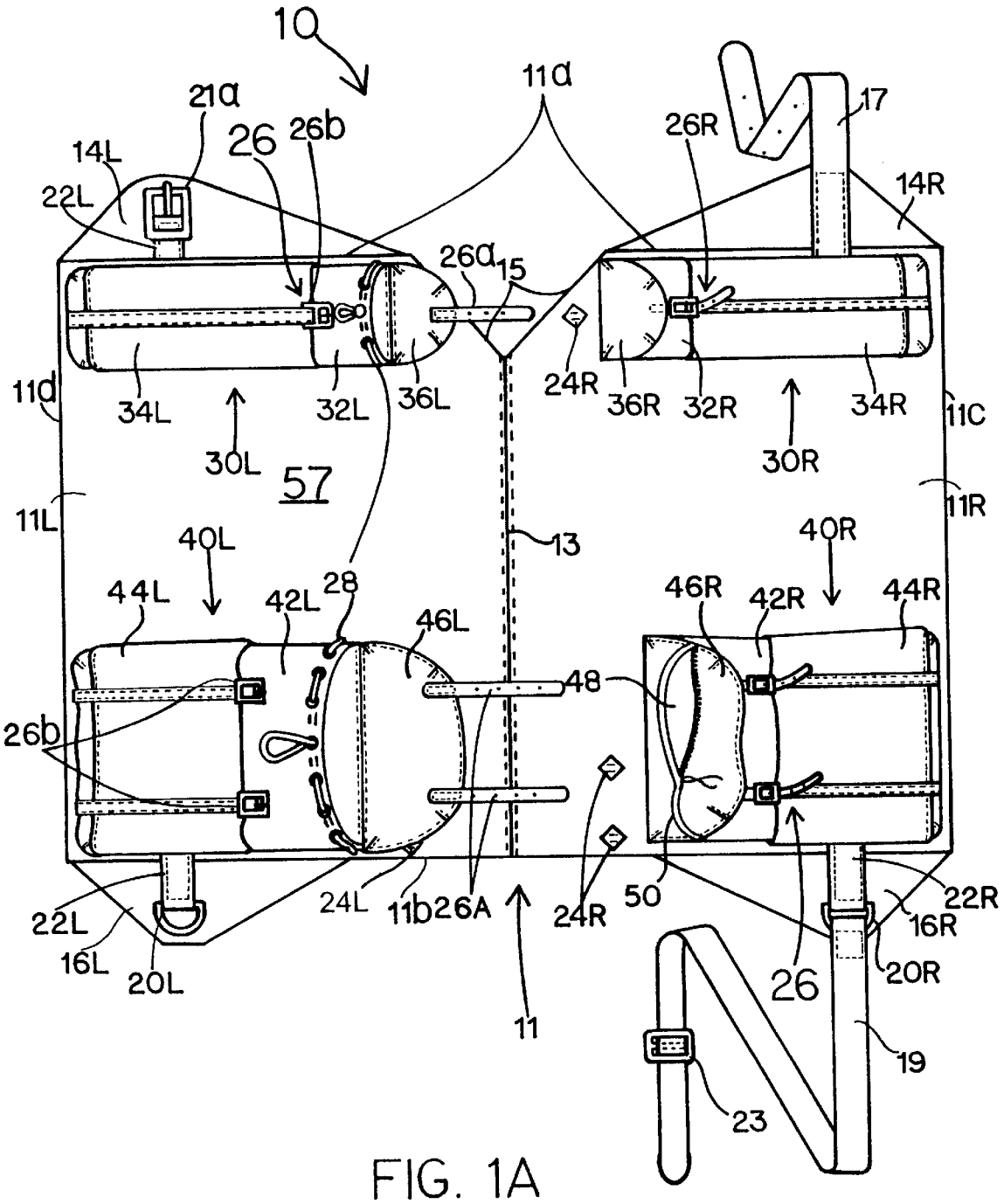
FIG. 1A is a top view of one embodiment of the invented horse pack, shown flattened out and removed from the bearing animal.

Referring now to FIG. 1A, which is a plan view of my horse pack 10, a support panel 11 comprises a right side 11R and a left side 11L. Sides 11R and 11L are approximately rectangular with equal dimensions. Sides 11R and 11L meet at a seam or top-line 13. Top-line 13 is adapted to conform to the natural curvature of the back (best shown in FIG. 2) of a riding animal such as a horse or mule. Support panel 11 includes a forward edge 11*a* and a rear edge 11*b*. Right side 11R has a right bottom edge 11*c*. Left side 11L has a left bottom edge 11*d*. Support panel 11 may be constructed from a unitary piece or sheet of fabric or two pieces of fabric joined at top-line 13.

A cutout 15, approximately V-shaped, bisects forward edge 11*a* at top-line 13. Cutout 15 removes approximately one-quarter of forward edge 11*a* and one-sixth of top-line 13.

A front bag 30 comprises a front main compartment 32, a front pocket 34, and a front lid 36. Main compartment 32 may be constructed with a length approximately equal to that of the length of forward edge 11*a* from bottom edges 11*c* or 11*d* to cutout 15, and a width and a depth each of approximately one-quarter to one-third the length. A drawstring 28 (best shown at rear bag 40L) is incorporated into top edge of main compartment 32. Lid 36 is constructed with dimensions allowing for lid 36 to be adapted to conformably overlap fully opened main compartment 32 by approximately 20%. A strap portion 26*a* (best shown as separate part at front bag 30L) of a lid strap 26 (best shown as joined on front bag 30R) is attached to approximate middle of front edge of lid 36 in an approximately vertical orientation, that is, generally perpendicular to the top-line 13. Front pocket 34 is constructed with dimensions of approximately one-half to three-quarters of the length of main compartment 32 and width approximately equal to the total of the widths of two sides and the front of main compartment 32. A buckle portion 26*b* (best shown as separate part at bag 30L) of lid strap 26 is attached to approximate middle of pocket 34 in an approximately vertical orientation. Pocket 34 is attached to main compartment 32 along its side and bottom edges with its open top edge below overlapping portion of lid 36. Pocket 34 may be attached to main compartment 32 along one or more additional lines parallel to its sides. Back edge of lid 36 is attached to upper edge of back side of main compartment 32. Front bag 30R is attached to right side 11R, and front bag 30L is attached to left side 11L. Alternatively, in FIG. 1B, the front bags of horse pack 110 are connected to the support panel over portions of straps 22', 17' and 19'. One side of front bags 30R and 30L are parallel and adjacent to front edge 11*a*. Bottom edges of front bag 30R and 30L are parallel and adjacent to bottom edges 11*c* and 11*d*, respectively.

A rear bag 40R (right) and 40L (left) comprises a rear main compartment 42, a rear pocket 44, and a rear lid 46. Main compartment 42 may be constructed with a height approximately three-quarters that of the length of forward edge 11*a* from bottom edges 11*c* or 11*d* to top-line 13, a width approximately three-quarters of the height, and depth of approximately one-half the width. Drawstring 28 is incorporated into open top edge of main compartment 42. Lid 46 has dimensions allowing it to be adapted to conformably overlap fully opened main compartment 42 by approximately 20%. Lid 46 may be constructed of two layers joined at their edges to form a pouch 48. Pouch 48 (best shown at rear bag 40R) is accessed through a zipper 50 (best show at rear bag 40R) which is incorporated into the top layer of lid 46. Lid 46 may be constructed to conformably overlap open top of main compartment 42 by approximately 20%. One or more of strap portion 26*a* of lid strap 26 is attached to front edge of lid 46 in an approximately vertical orientation. Rear pocket 44 is constructed with dimensions of approximately one-half to two-thirds the height of main compartment 42 and width approximately equal to the total of the widths of two sides and the front of main compartment 42. One or more buckle portion 26*b* of lid strap 26 is attached to pocket 44 in an approximately vertical orientation. Pocket 44 is attached to main compartment 42 along side and bottom edges with open top edge below overlapping portion of lid 46. Pocket 44 may be attached to main compartment 42 along one or more additional lines parallel to sides. Back edge of lid 46 is attached to upper edge of back side of main compartment 42. Rear bag 40R is attached to right side 11R, and rear bag 40L is attached to left side 11L. Alternatively, in FIG. 1B, the rear bags may be attached over portions of straps 22', 17' and 19'. One side of rear bags 40R and 40L is parallel and adjacent to rear edge 11*b*. Bottom edges of rear bags 40R and 40L are parallel and adjacent to bottom edges 11*c* and 11*d*, respectively.

Front and rear bags 30 and 40 may be attached to support panel 11 along all their edges or may alternately have portions of both side edges left unattached so that a generally horizontal channel (not shown) is formed between bags 30 and 40 and support panel 11 through which longer items, such a fishing rod or rifle, may be passed and supported for carrying.

Front and rear bags, 30 and 40 may alternately be constructed with support panel 11 forming the back surface of main compartments 32 and 42 and with side and bottom edges attached entirely to support panel 11. Lids 36 and 46 would then be attached directly to support panel 11 above main compartments 32 and 42, respectively. Pockets 34 and 44 may be attached to main compartments 32 and 42, respectively, along their side and bottom edges only or may be alternately attached along additional seams parallel to sides of main compartments 32 and 42 to create two or more separate pockets. Pockets 34 and 44 may be configured to lie flat against main compartments 32 and 42 as shown in FIGS. 1A and B or gathered at their top and bottom edges for expandability.

Front and rear bags 30 and 40 may alternately be comprised of a combination of outer bags permanently attached to support panel 11 and removable inner bags having handles or straps. Some parts of bags 30 and 40 may be altered or eliminated without affecting their main function of carrying items. These parts may include drawstrings 28, front and rear lids 36 and 46, front and rear pockets 34 and 44, and lid straps and buckles 26.

A chest strap support 14R (right) and 14L (left) is attached to right and left sides 11R and 11L, respectively, at forward edge 11*a*. Chest strap support 14 is an approximately scalene triangular piece of fabric attached to support panel 11 along its longest side. The shortest side adjoins bottom edge 11*c* or 11*d*. The length of the long side may be approximately equal to the height of front bag 30. The next longest side is approximately two-thirds the length of the longest side. The distance from the long side to opposite corner may be approximately one-third the length of the long side. Forward corner of left chest strap support 14L may be squared off or rounded as shown.

A rear strap support 16R (right) and 16L (left) is attached to right and left sides 11R and 11L, respectively, at rear edge 11*b*. Rear strap support 16 is also an approximately scalene triangle, with the length of the attached long side being approximately equal to the height of rear bag 40. The distance from the attached side to the opposite, rearward corner is approximately one-half the length of the attached side. Position of rearward corner is at the same level above bottom edges 11*c* or 11*d* as forward corner of front strap support 14. Left rear strap support 16L may be squared off or rounded as shown.

Figure 1B:
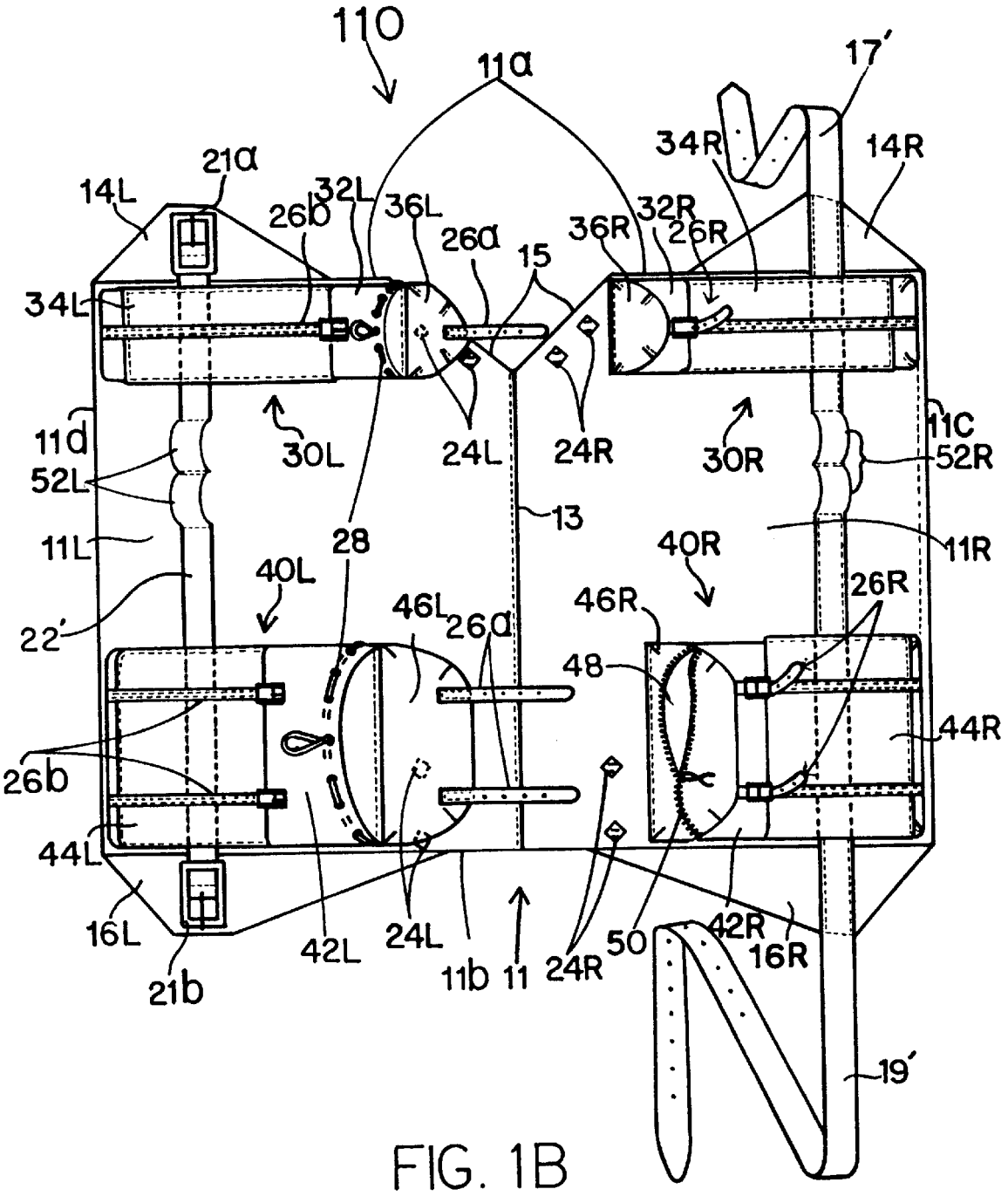
FIG. 1B is another embodiment of the invented horse pack, also shown flattened out and removed from the bearing animal.

FIGS. 1A and 1B show one of many possible fastening systems for the chest strap 17, 17'. Chest strap 17 may be attached or connected to chest strap support 14R centered over forward corner of support 14R. A front buckle 21 a attached to chest strap support 14L and/or 14R cooperates with strap 17. Alternatively, my invention may utilize a Y-shaped breast collar, for example, comprising two straps extending from the right and left portions of the support panel, joining at a ring near the front center of the animal's chest, and a third strap extending from the ring between the legs and attaching to the cinch.

FIGS. 1A and 1B illustrate two of the many possible fastening systems for the rear strap 19, 19'. In FIG. 1A, a D-ring 20R and 20L is connected to rear strap supports 16R and 16L, respectively, with a D-ring/buckle strap 22R and 22L. A rear strap 19 is attached to D-ring 20R or 20L and passed through opposite D-ring 20R or 20L. Rear strap 19 may then be fastened to itself by passing through an adjustment slider 23. The length of rear strap 19 may be approximately twice the length of support panel 11. In FIG. 1B, straps 17' and 19' connect to buckles extending from the left portion of the support panel.

Whereas D-rings 20R and 20L and adjustment slider 23 are shown and described herein, it should be noted that these are optional components and may be replaced by other types of hardware (such as round or rectangular rings, or buckles) or eliminated by attaching chest strap 17 and rear strap 19 directly to chest and rear strap supports 14 and 16 or support panel 11 without affecting the basic functionality of my saddle pack.

Figure 2:
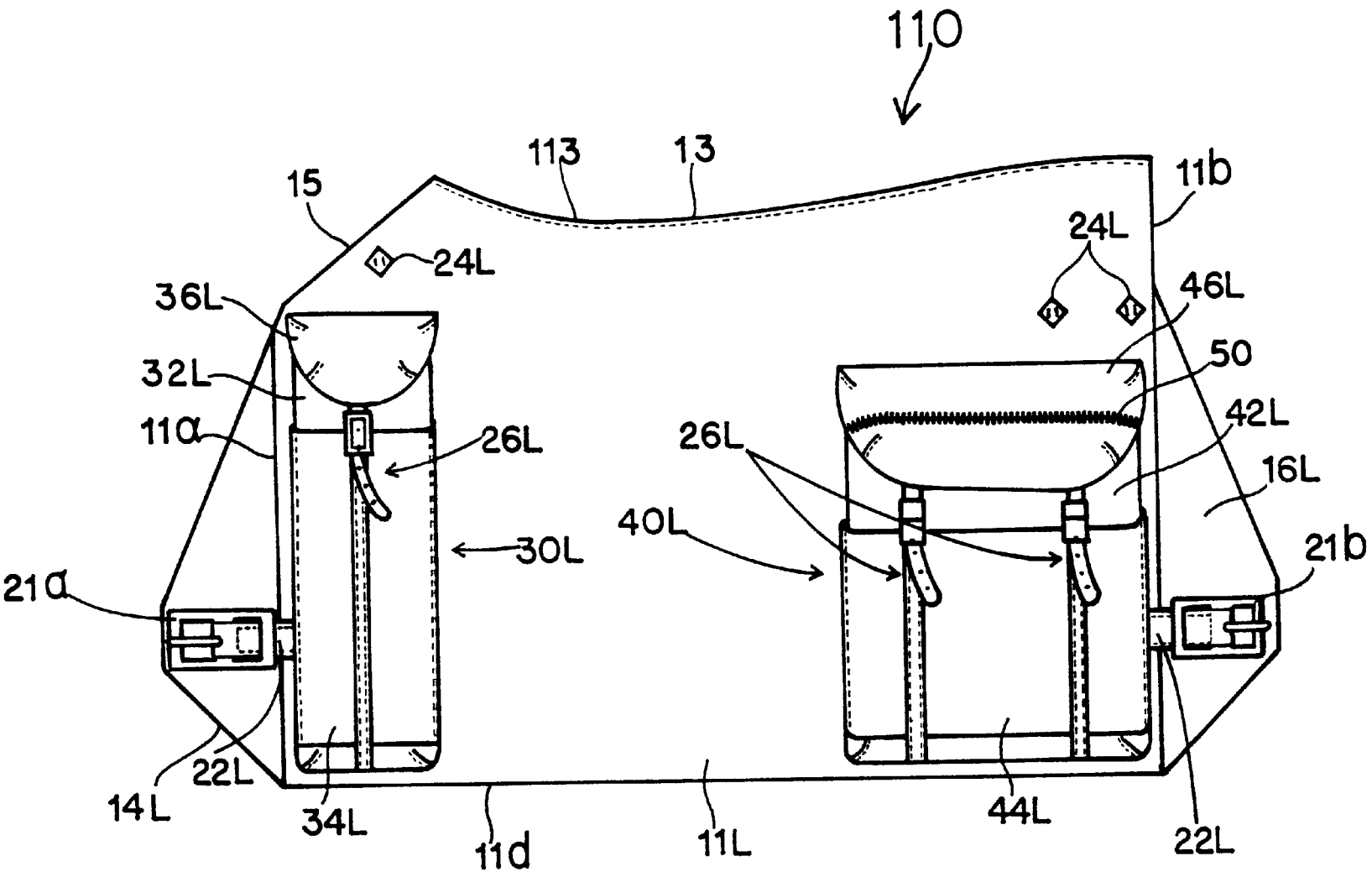
FIG. 2 is a left side view of the embodiment of FIG. 1B, positioned as if ready for placement over the back of the bearing animal.
Figure 3:
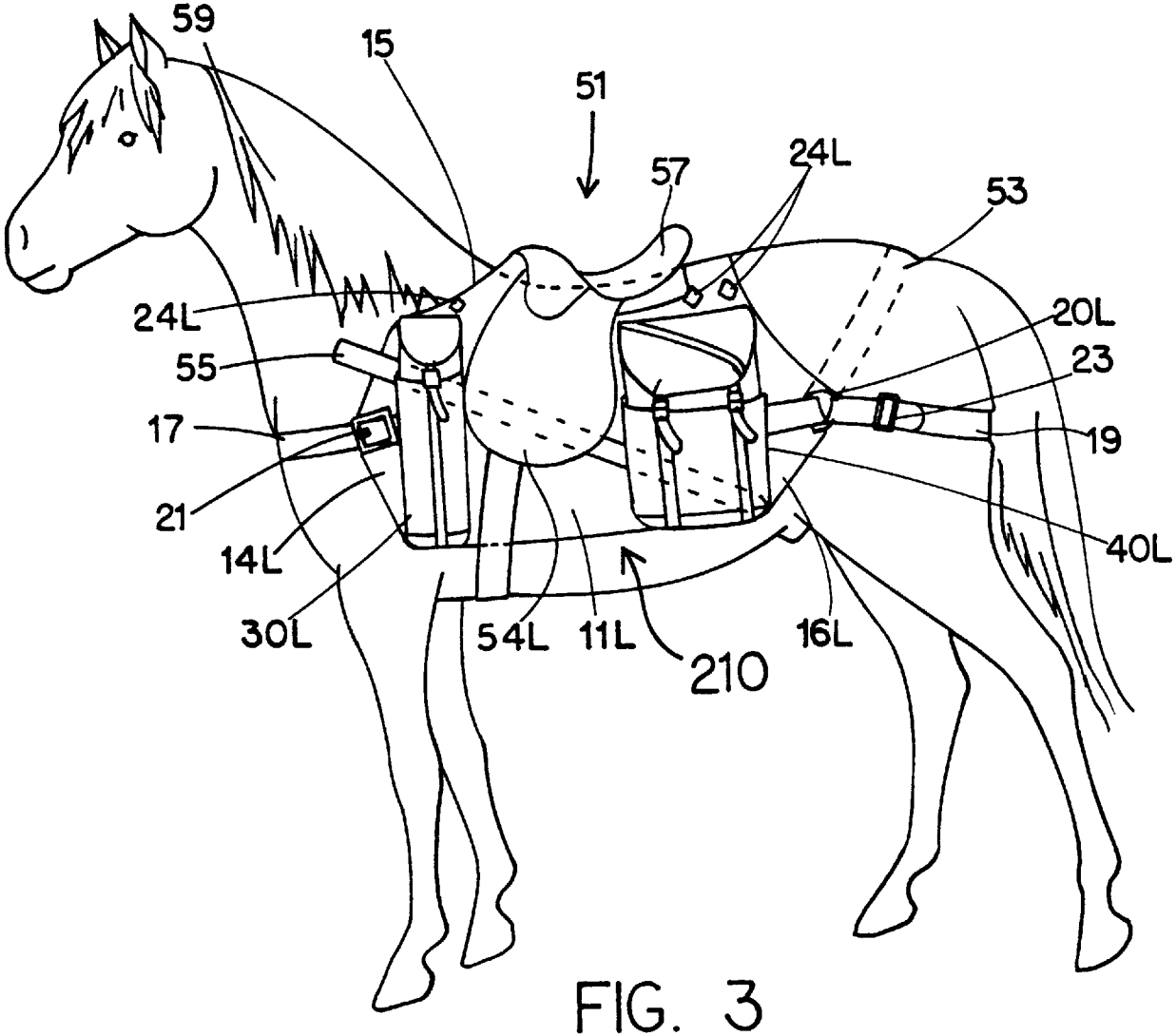
FIG. 3 is a left side view of another embodiment of the invention, installed over a bearing animal and in use with a saddle.

Whereas chest and rear strap supports 14 and 16 are shown and described herein, it should be noted that they are included as an option for the added comfort of the bearing animal and may be eliminated without affecting the basic functionality of my horse pack. Another configuration for strap supports 14 and 16 may comprise one or more straps attached to support panel 11 and to D-ring 20, which would replace triangular pieces as a means of supporting and preventing straps 17, 17', 19 and 19' from sagging or pulling upward. Whereas positions and lengths of chest strap 17 and rear strap 19 are shown and described herein, these properties may be modified to accommodate differences in size or needs of the animal or preferences of the user without substantially affecting functionality of my horse pack. Either the front or rear strap 17, 17', 19 and 19' may be permanently attached to front and rear strap supports 14 and 16, D-ring 20, and/or support panel 11 or they may be detachable. Also, chest and rear strap supports 14 and 16 may also be constructed as an extension of front and rear edges 11*a* and 11*b* of support panel 11 as shown in FIG. 3, rather than separate pieces as shown in FIGS. 1 and 2.

In FIG. 1B, optional girth slots 52R and 52L, which are unattached portions of the straps 22', 17', 19' extending between the front or rear bags, may advantageously provide a stabilizing means for the saddle, but may be considered as an option as my horse pack is fully stabilized from forward and rearward slippage or bouncing by straps 17' and 19'.

A plurality of strap patches 24 may be located on support panel 11 between front bags 30R and 30L and cutout 15, and between rear bags 40R and 40L near rear edge 11*b*. Strap patches 24 comprise reinforced slotted patches attached to support panel 11 through which straps or lashings may be passed, but may also consist of, but are not limited to, pairs of reinforced slots or holes in support panel 11, or loops attached to support panel 11, or other means of attaching articles to support panel 11. While strap patches 24 are shown and described herein, it should be understood that they may be considered as an option or enhancement which, if eliminated, would not substantially affect the functionality of my horse pack.

Other details of bag construction may be adapted for custom-design or personal preference. Drawstring 28 may include, but is not limited to, grommets, reinforced holes or a sleeve through which a drawstring may be passed or other means by which an opening may be closed, secured, or constricted. Lid strap 26 as illustrated in FIGS. 1–4 are comprised of straps and buckles, but may be alternately comprised of, but not limited to, lashings, hook and loop fasteners, hook and eyes, heavy snaps or other any other appropriate detachable fastening means. Zipper 50 may include, but are not limited to, zippers as shown in FIGS. 1–4 or straps and buckles, hook and loop fasteners, snap fasteners, hook and eyes, or other appropriate closure means. Zipper 50 may be oriented straight across the width of rear lid as shown in FIGS. 1 and 2, oblique as in FIGS. 3 and 4, or other orientations.

Referring now to FIG. 2, which shows my horse pack 110 as it appears when folded at top-line 13 and viewed from left side 11L, it can be seen that top-line 13 has a distinct curvature which approximates the natural curvature characteristic of the back of an equine animal. In this embodiment, a rear buckle 21*b* is shown here as replacing the D-ring 20 and adjustment slider 23 of FIG. 1A. The curvature of top-line 13 inward at its middle region 113 may be created by means of construction, for example, curved top edges of the left and right portions sewn together, or by virtue of the materials used, i.e. by stretchability, or both.

FIG. 3 shows a left side view of my horse pack 210 as mounted on a horse 57 with saddle 51 resting on top of the horse pack 10 (stirrups and stirrup leathers not shown). As shown in FIG. 2 and the other Figures, the chest strap 17 and rear strap 19 preferably extend generally horizontally around the chest and rear quarters of the horse, respectively. It can be seen that the adaptation of top-line 13 to the curvature of back of horse 57 allows support panel 11 to lie smoothly over the back of horse 57. Whereas horse 57 is used for illustration purposes, it should be noted that curvature of top-line 13 is generally adaptable to most equines including mules. Top-line 13 can be easily modified to accommodate unusual back conformations or other types of animals. The right side 11R and left side 11L may be a fabric right portion and a fabric left portion, each with a top edge that curves inward (downward in FIG. 3) between the front and rear edges of the portion. The curved top edges may be sewn together to form the curvature of top-line 13, to produce what may be called a generally concave shape for the top area of the support panel 11.

Whereas saddle 51 is shown to be of English type, my horse pack is equally adapted to use with most common types of saddles including Australian, McClellan, and Western saddles, or may be used without a saddle. Rear strap 19 may be placed in an alternate rear strap position 53 and tightened with adjustment slider 23 to help support weight of rear bags 40. A crupper (not shown) consisting of a strap looped under the tail of the horse may be attached to rear strap 19 to prevent it from sliding forward in long, steep descents. Optionally, an additional strap similar to strap 19 (not shown) may be attached to D-rings 20R and 20L, respectively, to utilize both normal and alternate position 53 of rear strap 19 concurrently for even greater stability of the load.

Approximate dimensions and relative proportions of parts of my horse pack 10 may be determined by the size of animal and/or saddle it is made to be used with, or personal preference. All proportions described herein are to be considered as one of many possible variations. In general, however, the support panel 11 preferably extends in all directions beyond the horizontal extent of the saddle, which rests on its upper surface 57, in order for its lower surface to contact and cover, preferably, substantially all of the back and barrel of the bearing animal, and portions of the shoulders and hips of the bearing animal. Typically, but not necessarily, the front bags 30 will be in the range of 12 to 18 inches from the rear bags 40 for the English version, and typically, but not necessarily, at least 10 inches apart for the Western version, to provide adequate room for receiving of the saddle between the bags.

Figure 4:
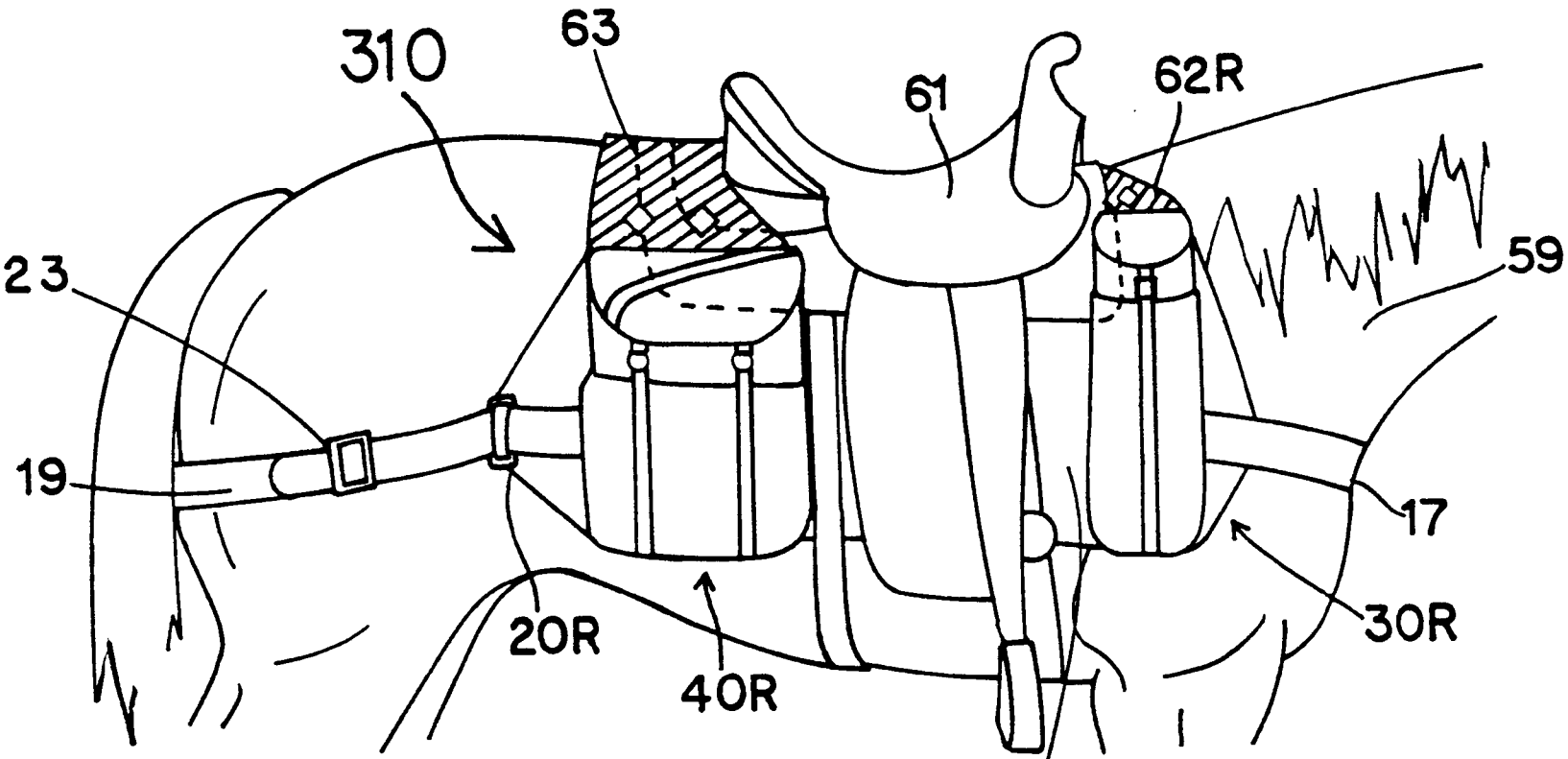
FIG. 4 is a right side view of another embodiment of the invented horse pack, in use with a large-skirted western saddle.

Referring now to FIG. 4, an example of one variation of my saddle pack 310 for use with some Western saddles which have a large skirt is shown. One approach to fitting the Western saddle would be to shorten the rear bags 40R and 40L and narrow the front bags 30R and 30L enough to accommodate the skirt of the saddle. Referring now to FIG. 4, if it is not desirable to substantially alter the dimensions of support panel 11 and/or lose capacity by altering the size of front bags 30 front or rear bags 40 to accommodate the larger square skirt of a Western saddle 61, the upper portion of both rear and front bags 30 and 40 may be left unattached to support panel 11. The upper portion of front bag 30 and rear bag 40 would then extend over and above the lower portion of the skirt of Western saddle 61. This would allow for the extra width of the skirt without reducing the size of front and rear bags 30 and 40. For support and stability of the detached upper portions of rear bag 40, a rear bag support panel 63 (shaded), is attached to the upper edge of the right rear bag 40R and extends over support panel 11 to the uppermost edge of the left rear bag 40L. Rear bag support panel 63 may have a curvature in its forward edge to accommodate cantle of Western saddle 61. Rear bag support panel 63 may be attached to support panel 11 along its rear edge for added stability. A front bag support panel 62R (shaded) and 62L is attached to the upper edge of front bags 30R and 30L, respectively, and to the upper edge of support panel 11 at cutout 15. The rear edge of Western saddle 61 may then be positioned between support panel 11 and rear bag support panel 63. The forward edge of skirt of Western saddle 61 may be positioned between front bag support panels 62R and 62L and support panel 11. Strap patches 24 may be attached to front bag support panel 62R and 62L and rear bag support panel 63.

My horse pack 10 may be constructed of any textile, synthetic or natural, or leather, or combination of such materials with attributes of durability and suppleness. Front and rear bags 30 and 40 and front and rear lids 36 and 46 may be preferably constructed of waterproof materials such as coated nylon or waterproofed canvas or duck or other suitable material. Front and rear pockets 34 and 44 may be constructed from same or heavier fabric as bag for the advantage of extra durability, or durable mesh fabric for the advantage of carrying dirty or wet articles. Straps 17, 19, 26*a,* and 26*b* may be constructed from nylon, polyester, cotton or other natural or synthetic webbing, strapping, leather, or any other suitable material. Buckle 21 may be constructed of metal, durable plastic or other durable materials. Buckle 21 may be of different design, than shown in FIGS. 1–4, such as commercially available nylon quick-releasing types, or any other appropriate fastening means. Front bag support panel 62 and rear bag support panel 63 may alternately comprise one or more straps.

Means of attachment of parts of my horse pack to each other may include, but are not limited to, sewing or riveting or a combination of both for permanent attachment; or for detachable components, straps and buckles, hooks and eyes, or hook and loop detachable means where appropriate. Support panel 11 may be constructed of durable mesh fabric to provide greater breathability. Support panel 11, chest and rear strap supports 14 and 16, and chest and rear straps 17 and 19 may optionally be lined on their undersides with soft, non-abrasive material for the added comfort of the animal.

Some parts of my saddle pack have been included here as examples of enhancements to my pack and may be altered or eliminated without affecting the overall functionality of the pack. These parts may include, strap patches 24, pouches 48, zipper 50, chest and rear strap supports 14 and 16, drawstrings 28, front and rear lids 36 and 46, front and rear pockets 34 and 44, and lid straps and buckles 26, and one of the two possible positions of rear strap. Optionally, top-line 13 may be straight rather than curved.

Figure 5:
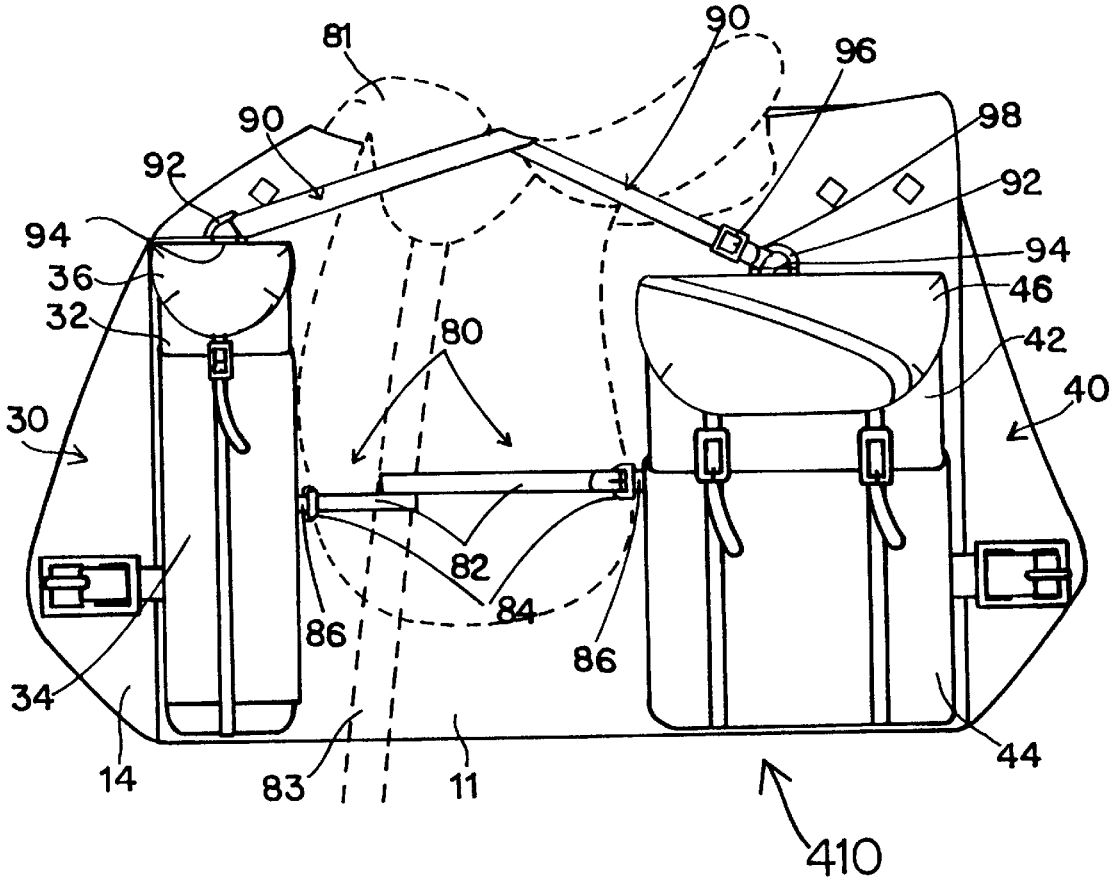
FIG. 5 is a schematic left side view of an alternative embodiment having straps for receiving a saddle cinch and straps for extending across the saddle.

Although my saddle pack does not require attachment to the saddle for its support or stability, in some situations, it may be advantageous to fasten the saddle to my horse pack 410. Referring to FIG. 5, an optional means for attaching support panel 11 to a saddle 81 is shown. A pair of cinch straps 80 each comprises a buckled strap 82 looped through a dee 84, for example, a D-ring. Dee 84 is attached to a dee strap 86. Dee strap 86 may be attached to support panel 11 adjacent to rear edges of front bags 30 and front edges of rear bags 40. Cinch straps 80 may then be looped around cinch 83 and buckled to themselves. Cinch straps 80 may then advantageously prevent saddle 81 from forward or rearward slippage.

Also shown in FIG. 5, are a pair of saddle straps 90, each attached to a saddle dee 92. Saddle dee 92 is attached to a saddle dee strap 94. Saddle dee strap 94 is attached to support panel 11 adjacent to top edge of front bags 30R and 30L. A pair of saddle strap buckles 96 is each attached to a buckle strap 98. Buckle strap 98 may be attached to support panel 11 adjacent to top edge of rear bag 40. Saddle straps 90 may then be placed across saddle 81 and buckled to the diagonal opposite saddle strap buckle 96. Saddle straps 90 lie smoothly across saddle 81 and will allow a rider to site comfortably on top of them. In this configuration, saddle straps 90 will not only help to stabilize saddle 81, but can also transfer some of the weight of front and rear bags 30 and 40 to saddle 81.

In addition, cinch straps 80 and saddle straps 90 may also be used for other purposes such as fastening other items to my horse pack. Also, straps 80 may be adjusted to extend through a rigging dee on the saddle rather than around the cinch 83.

Operation of the Preferred Embodiments

The use and operation of my horse pack 10 is simple and straightforward. Referring again to FIG. 3, my horse pack 10 is placed on the animal's back with right and left sides 11R and 11L of support panel 11 positioned over right and left sides of the animal, respectively. Alternatively, but not necessarily, the horse pack 10 may be placed over a pad with similar dimensions as support panel 11. Top-line 13 is positioned directly over and parallel to the spine of the animal. The point of cutout 15 should be positioned at approximately the base of the crest of horse 59. The curvature of top-line 13 should then be approximately matching the corresponding curve of the animal's back. Chest strap 17 is then placed around the chest of horse 59, passed through buckle 21*a,* adjusted and secured. Rear strap 19 is placed around the rear quarters or in alternate rear strap position 53 over the croup just above the tail of horse 59, and adjusted with adjustment slider 23. Items may then be placed in main compartments 32 and 42 paying attention to the proper balance between right and left sides 11R and 11L. Drawstrings 28 are then drawn tight. Front and rear lids 36 and 46 are then secured to main compartments 32 and 42, respectively, by securing strap portions 26*a* to buckle portions 26*b* of lid strap 26. Smaller items requiring quick or frequent access may be loaded in pouches 48 or front and rear pockets 34 and 44. Additional items, such as a bedroll or ropes, may be attached by straps or lashings passed through the strap patches 24. A longer item 55 such as a fishing rod case, or rifle may passed through the channels between support panel 11 and front and rear bags 30 and 40. The saddle is then placed over the support panel 11 with right leg flap 54R between right front and rear bags 30R and 40R and left leg flap 54L between left front and rear bags 30L and 40L. Seat 57 will then be positioned between rear bags 40R and 40L. Optionally, according to FIG. 1B, the girth may be passed through girth slots 52 and secured to the saddle. Saddle 51 as well as my horse pack are prevented from shifting during climbing or descending by the proper adjustment of strap 17 and rear strap 19. Rear strap 19 may be positioned around the thighs of the animal to reduce bouncing and shifting or, if rear bags 40 are heavily loaded, it may be placed over the croup above the tail of the animal and adjusted snugly to assist in holding the weight of rear bags 40. In either position, rear strap 19 prevents forward slippage.

Although this invention has been described above with reference to particular means, materials and embodiments, it is to be understood that the invention is not limited to these disclosed particulars, but extends instead to all equivalents within the scope of the following claims.

What is claimed is:

1. A pack system for conveyance upon a bearing animal comprising:

a plurality of bags for carrying items;

a support panel having an upper surface and having a lower surface for contacting the back, barrel, shoulders and hips of a bearing animal, the support panel having a right portion for contacting the right side of the bearing animal and a left portion for contacting the left side of the bearing animal, wherein the right portion has a front edge and a rear edge and the left portion has front edge and a rear edge;

means for connecting said bags to said support panel; and a saddle contacting the upper surface of the support panel near the back of the bearing animal, the saddle having a horizontal extent; and wherein the support panel extends beyond the horizontal extent of the saddle in all directions to cover portions of the back and barrel of the bearing animal;

wherein the plurality of bags comprises right and left front bags and right and left rear bags wherein said saddle comprises leg members and a seat, and wherein said leg members and seat are located between and in close proximity to said front bags and said rear bags.

2. The pack system of claim 1, wherein the saddle is not connected to and not attached to the support panel and the saddle is not connected to and not attached to the bags.

3. A pack system for conveyance upon a bearing animal comprising:

a plurality of bags for carrying items;

a support panel having an upper surface and having a lower surface for substantially covering the back and barrel of a bearing animal, the support panel having a right portion for contacting the right side of the bearing animal and a left portion for contacting the left side of the bearing animal, wherein the right portion has a front edge and a rear edge and the left portion has front edge and a rear edge; and means for connecting said bags to said support panel;

wherein the support panel is adapted for extending beyond a horizontal extent of a saddle in all directions to cover portions of the back and barrel of the bearing animal;

the pack system further comprising a means for retaining the support panel and bags in place on the bearing animal, the retaining means comprising:

a first strap connected to and extending generally horizontally between the support panel right portion and left portion front edges for extending generally horizontally around the chest of the bearing animal; and a second strap connected to and extending generally horizontally between said right portion and left portion rear edges for extending generally horizontally around rear quarters of said bearing animal;

wherein said first and second straps secure said support panel and said attached bags from shifting forward or backward on said bearing animal.

4. The pack system of claim 3, further comprising a third strap connected to and extending between said right portion and left portion rear edges for extending around rear quarters of said bearing animal above the bearing animal's tail.

5. The pack system of claim 1 wherein the right portion further has a top edge with a middle region, and the left portion further has a top edge with a middle region, and wherein each of the right portion and left portion top edges are curved from near the front edges and rear edges inwardly toward the top edge middle region, and wherein the right portion and left portion join at their curved top edges to form a top-line, wherein the top-line is generally concave for contouring to the back of the bearing animal.

6. The pack of claim 5, further comprising a means for retaining the support panel and bags in place on the bearing animal, the retaining means comprising:

a first strap connected to and extending between the support panel right portion and left portion front edges for extending around the chest of the bearing animal; and a second strap connected to and extending between said right portion and left portion rear edges for extending around rear quarters of said bearing animal;

wherein said first and second straps secure said support panel and said attached bags from shifting forward or backward on said bearing animal.

7. The pack system of claim 6, wherein the second strap curves upward and rearward to extend across the bearing animal's croup just above the tail.

8. The pack system of claim 6, further comprising a third strap connected to and extending between said right portion and left portion rear edges for extending across the croup just above the tail of said bearing animal.

9. A pack for carrying items on a bearing animal comprising:

a plurality of bags for receiving items to be carried;

a support panel for contacting at least portions of the back and barrel of the bearing animal, the support panel having a generally rectangular right portion for contacting the right side of the bearing animal and a generally rectangular left portion for contacting the left side of the bearing animal, wherein the right portion has a front edge, a rear edge, and top edge with a middle region, and the left portion has front edge, a rear edge, and a top edge with a middle region, and wherein each of the right portion and left portion top edges are curved from near the front edges and rear edges inwardly toward the top edge middle region, and wherein the right portion and left portion join at their curved top edges to form a top-line, wherein the top-line is generally concave for contouring to the back of the bearing animal;

means for attaching said bags to said support panel;

wherein the plurality of bags comprises four bags which are right and left front bags near the right and left portion front edges and right and left rear bags near the right and left portion rear edges.

10. A pack system for conveyance upon a bearing animal comprising:

a plurality of bags for carrying items;

a support panel having an upper surface and having a lower surface for contacting the back, barrel, shoulders and hips of a bearing animal, the support panel having a right portion for contacting the right side of the bearing animal and a left portion for contacting the left side of the bearing animal, wherein the right portion has a front edge and a rear edge and the left portion has front edge and a rear edge; and means for connecting said bags to said support panel;

wherein the plurality of bags comprises right and left front bags and right and left rear bags, wherein the front bags are distanced from the rear bags to adapt the front bags for placement in front of a saddle and to adapt the rear bags for placement to the rear of the saddle.

11. A pack system was in claim 10, wherein the right portion further has a top edge with a middle region, and the left portion further has a top edge with a middle region, and wherein each of the right portion and left portion top edges are curved from near the front edges and rear edges inwardly toward the top edge middle region, and wherein the right portion and left portion join at their curved top edges to form a top-line, wherein the top-line is generally concave for contouring to the back of the bearing animal.

12. The pack of claim 11, further comprising a means for retaining the support panel and bags in place on the bearing animal, the retaining means comprising:

a first strap connected to and extending between the support panel right portion and left portion front edges for extending around the chest of the bearing animal; and a second strap connected to and extending between said right portion and left portion rear edges for extending around rear quarters of said bearing animal;

wherein said first and second straps secure said support panel and said attached bags from shifting forward or backward on said bearing animal.

13. The pack system of claim 12, wherein the second strap curves upward and rearward to extend across the bearing animal's croup just above the tail.

14. The pack system of claim 12, further comprising a third strap connected to and extending between said right portion and left portion rear edges for extending across the croup just above the tail of said bearing animal.

* * * * *